United States Patent [19]

Beale

[11] Patent Number: 4,648,397

[45] Date of Patent: Mar. 10, 1987

[54] ELECTRONICALLY COMPENSATED PRESSURE DILUTION DEMAND REGULATOR

[75] Inventor: Robert B. Beale, Arden Hills, Minn.

[73] Assignee: The United States of America as represented by the Secretary of the Air Force, Washington, D.C.

[21] Appl. No.: 791,959

[22] Filed: Oct. 28, 1985

[51] Int. Cl.[4] ..... A62B 7/00

[52] U.S. Cl. ..... 128/205.11; 128/204.26; 128/204.29; 137/81.1

[58] Field of Search ..... 128/204.26, 204.29, 128/205.11; 137/81.1, 78.5

[56] References Cited

U.S. PATENT DOCUMENTS

| | | | |
|---|---|---|---|
| 2,897,833 | 8/1959 | Seeler | 137/64 |
| 3,875,957 | 4/1975 | Veit et al. | 137/81 |
| 4,121,578 | 10/1978 | Torzala | 128/142 R |
| 4,274,404 | 6/1981 | Molzan et al. | 128/204.25 |
| 4,340,044 | 7/1982 | Levy et al. | 128/204.21 |
| 4,355,735 | 6/1982 | Cramer et al. | 137/81.1 |

*Primary Examiner*—Stephen F. Husar

*Attorney, Agent, or Firm*—Thomas L. Kundert; Donald J. Singer

[57] ABSTRACT

The present invention relates to a dilution control oxygen regulator for providing a desired oxygen concentration at different altitudes and pressures. Two valves supply oxygen and air to a recipient's mask. A pressure transducer in the mask measures suction pressure which is compared with a prescribed pressure command signal for a particular altitude to produce a pressure error. The error signal is compensated by a proportional-plus-integral controller, and is biased between the two gas valves proportional to an oxygen concentration schedule which prescribes a desired oxygen concentration percentage based on altitude. The biased and compensated error signal is used as valve opening displacement commands for establishing desired valve opening areas. A feedback loop around the electromechanical valve actuator means improves the stability and accuracy of valve settings.

8 Claims, 1 Drawing Figure

ELECTRONICALLY COMPENSATED PRESSURE DILUTION DEMAND REGULATOR

RIGHTS OF THE GOVERNMENT

The invention described herein may be manufactured and used by or for the Government of the United States for all governmental purposes without the payment of any royalty.

CROSS REFERENCE TO RELATED APPLICATIONS

This application is related to my copending patent application Ser. No. 791,955 for an Electromechanical Oxygen Regulator Valve Assembly filed on Oct. 28, 1985. The specification and claims of that patent are hereby incorporated by reference herein.

BACKGROUND OF THE INVENTION

1. Field of the Invention

Advanced high performance aircraft require an oxygen delivery system to supply breathing gas to aircraft crew members that is neither too high in oxygen content as to result in hyperoxia or too low so as to prevent hypoxia resulting in crew member fatigue or hyperventilation. Currently designed pneumatic regulators are not sufficiently accurate or responsive to changed conditions causing excessive oxygen in the breathing mixture under some conditions and insufficient oxygen under others.

The present invention is an improved dilution control oxygen regulator that provides a prescribed pressure and oxygen concentration based on altitude.

2. Description of the Prior Art

Several prior patents have been issued for devices pertaining to the regulation of an oxygen air mixture. U.S. Pat. No. 4,121,578 by Torzala discloses an aircraft oxygen regulator which supplies the recipient with a mixture of breathable fluid proportional to the altitude at which the aircraft is flying. The feed mixture is modified by determining the amount of inspired oxygen utilized during each breath and comparing the same with a reference for the recipient. A feedback signal indicative of a recipient's physiological needs is used to operate an oxygen regulator. U.S. Pat. No. 4,340,044 by Levy et al discloses a medical ventilator for switching and mixing oxygen with air with a servocontrol device and logic circuitry. U.S. Pat. No. 4,335,735 by Cramer et al discloses an oxygen regulator for controlling the flow of breathing oxygen that includes a balanced oxygen valve and air valve which cooperate with a dilution aneroid valve. U.S. Pat. No. 2,897,833 by Seeler discloses a pressure control dilution valve for maintaining a constant pressure at its outlet regardless of the mixture ratio of air and oxygen used. U.S. Pat. No. 3,875,957 by Viet et al teaches an oxygen-air dilution in three different modes of operation to provide normal air dilution, 100% oxygen and pressure breathing. U.S. Pat. No. 4,274,404 by Molzan et al discloses an oxygen supply system for human inhalation of oxygen with an oxygen pressure regulator and a means to shut-off oxygen from the source when a build-up of oxygen pressure exists. However, none of the references teach a combination of the features of the present invention which includes a controller for biasing oxygen and air valves based on a prescribed pressure command and oxygen concentration schedule.

SUMMARY OF THE INVENTION

It is the primary object of the present invention to provide a means for regulating a supply of breathable air, at varying altitudes that is responsive to a recipient's physiological needs.

It is a further object of the present invention to eliminate the dependence of regulator performance on supply air pressure and supply oxygen concentration conditions.

It is still a further object of the present invention to provide a microprocessor controlled, electromechanical valve actuated regulator.

It is a further object of this invention to reduce the need for excessive suction pressures.

It is a further object of this invention to provide an electronically compensated dilution demand regulator that uses a "proportional-plus-integral" controller to compensate an error signal.

These and other objects are accomplished by the present invention which includes a controller for regulating two valves connected to air and oxygen supplies, that supply oxygen and air flows to a recipient's mask. A pressure transducer in the recipient's mask measures suction pressure which is then converted to an electrical signal indicative of the user's demand for breathing gas. The demand signal is then compared with a prescribed pressure command signal for a particular altitude to produce a pressure error. The pressure error is used as a valve command signal after being compensated by a proportional-plus-integral controller and biased between the two gas valves. The proportional path provides rapid response to pressure errors while the integral path is used to eliminate long term offsets.

The compensated pressure error is biased between the two gas valves proportional to an oxygen concentration percentage based on altitude.

The biased error signal is then used as a valve command to establish desired valve opening areas and thereby control the supply of oxygen and air through the two valves. Position feedback around electromechanical valve actuators, sensed by a position transducer, improves the stability and accuracy of the valve setting. Using the apparatus of the invention, the desired oxygen concentration may be achieved over a broad range of altitudes and at different oxygen and air supply pressures. The operations performed by the controller may be accomplished with an electronic microprocessor.

DESCRIPTION OF THE PREFERRED EMBODIMENT

Figure 1:
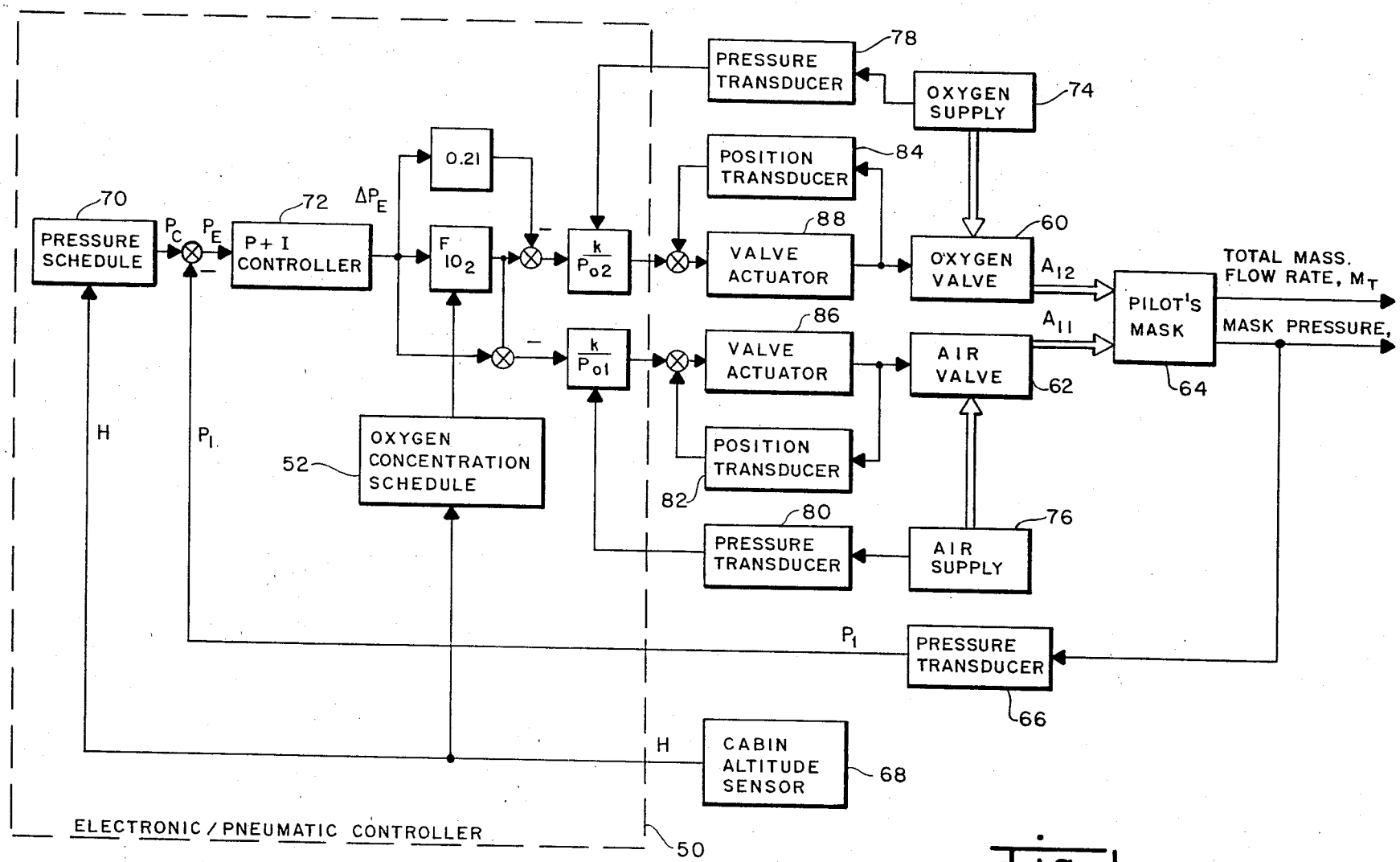
FIG. 1 shows a block diagram of the invention.

FIG. 1 shows in block form a controller 50 for regulating two gas valves, 60, 62, one for oxygen supply 74 and one for air supply 76 which deliver a breathable gas mixture to a pilot's mask 64. Mask suction pressure, $P_1$, indicating the user's demand for breathing gas is sensed and converted to an electrical signal by pressure transducer 66. Cabin altitude sensor 68 senses the altitude, H, and a signal indicative of altitude is fed to a pressure command schedule 70 to generate a signal $P_C$ indicating a prescribed pressure based on a command rate for a specific altitude. An example of a pressure command schedule is as follows:

```
PC=0.0

IF(H.GE.28000.) PC=1.0

IF(H.GE.38000.) PC=0.00125*(H-38000.)+1.0

IF(H.GE.42000.) PC=0.00172*(H-42000.)+6.0

IF(H.GE.46000.) PC=0.0005*(H-46000)+12.88

IF(H.GE.47000.)
  PC=0.0022333333*(H-47000.)+13.38

IF(H.GE.50000.)
  PC=0.001946666*(H-50000.)+20.08

IF(H.GE.56000.) PC=0.0015275*(H-56000.)+31.76

IF(H.GE.60000.) PC=37.87

IF(H.GE.38000.) PC=0.001333*(H-38000.)+1.0

IF(H.GE.60000.) PC=30.33
```

where $P_C$ is in inches of water.

H is altitude in feet.

GE means greater or equal

It will be understood by those skilled in the art that the pressure command schedule may be modified or tailored for specific applications and that the above pressure command schedule is only illustrative of the invention.

Pressure signal $P_C$ is compared with the demand signal, $P_1$, generated by pressure transducer 66 to produce a pressure error, $P_E$. The pressure error $P_E$ is compensated by a proportional-plus-integral controller 72 to provide rapid response to pressure errors and to eliminate long-term offsets. The resultant pressure error, $\Delta P_E$, is then biased between the two gas valves 60, 62 and serves as a valve command for valve actuators 86, 88.

Pressure error, $\Delta P_E$, from the proportional-plus-integral controller 72, is biased between the two gas valves 60, 62 in proportion to an oxygen concentration schedule 52 which prescribes a desired oxygen concentration percentage based on altitude. For purposes of illustration the oxygen concentration schedule is listed as follows:

```
FIO2=0.21

IF(H.GE.14000.)
  FIO2=((0.5-FIO2)/3000.)*(H-14000.)+FIO2

IF(H.GE.17000.)
  FIO2=0.000045455*(H-17000.)+0.5

IF(H.GE.28000.) FIO2=1.0
```

where $F_{IO2}$ is the fractional concentration of oxygen in the total gas stream and ranges from 21–100% (0.21–1.0).

H is altitude in feet.

GE means greater or equal.

The valve command bias is derived as shown in the following analysis. The concentration of oxygen is the ratio of the mass flow of each gas. Since air is 21% oxygen, the fractional concentration of oxygen, $F_{IO2}$, may be expressed as $$F_{IO2} = \frac{\dot{M}_{O2} + .21\dot{M}_{air}}{\dot{M}_T}$$

where $M_T$=Total mass flow rate of gas.

$M_{O2}$=Mass flow rate of oxygen supply.

$M_{air}$=Mass flow rate of air supply.

$M_T = M_{O2} + M_{air}$ therefore $$\dot{M}_{O2} = \dot{M}_T\left(\frac{F_{IO2} - .21}{0.79}\right)$$

and $$\dot{M}_{air} = \dot{M}_T\left(\frac{1 - F_{IO2}}{0.79}\right)$$

It will be observed from the above listed oxygen concentration schedule that $F_{IO2}$ is 0.21 for altitudes less than 14,000 feet, and $F_{IO2}$ is 1.0 for altitudes equal to or greater than 28,000 feet. Thus, $\dot{M}_{O2}$ will be zero below 14,000 feet and $\dot{M}_{air}$ will be zero at or above 28,000 feet.

The mass flow of each gas is proportional to the valve opening area and the supply pressure.

$\dot{M}_{air} = kA_{11}P_{01}$ $\dot{M}_{O2} = kA_{12}P_{02}$ where $P_{01}$=Pressure of air supply.

$P_{02}$=Pressure of oxygen supply.

$A_{11}$=Area of air valve opening.

$A_{12}$=Area of oxygen valve opening.

k=Conversion factor for converting valve area to displacement and equal to $\pi$ times the diameter of the valve opening.

The factor k is inserted so that the resultant valve command will be the desired displacement for each valve. The valve commands are converted by servoamplifier means (not shown) into electrical signals to move valve actuators 86, 88 until the desired position (displacement) is achieved as sensed by position transducers 82, 84.

The corresponding area of the openings of oxygen valve 60 and air valve 62 for a particular valve displacement command will be as follows.

$$A_{11} = \dot{M}_T\left(\frac{1 - F_{IO2}}{0.79kP_{01}}\right)$$

$$A_{12} = \dot{M}_T\left(\frac{F_{IO2} - .21}{0.79kP_{01}}\right)$$

Referring again to the oxygen concentration schedule, for altitudes below 14,000 feet, the oxygen valve area $A_{12}$ is zero, and only air is supplied to the pilot's mask. At or above altitudes of 28,000 feet, the air valve area $A_{11}$ is zero and only oxygen is supplied to the pilot's mask. Between 14,000 and 28,000 feet, both oxygen and air are supplied as a function of valve area ratio.

As seen in FIG. 1, the oxygen supply pressure at oxygen supply 74 and air supply pressure at air supply 76 are sensed by pressure transducers 78 and 80 and are compensated for by dividing the respective valve commands by the measured values. Valves 60, 62 are preferably of the type described in my copending application Ser. No. 791,955 for an Electromechanical Oxygen Regulator Valve Assembly, filed Oct. 28, 1985 which incorporate therein valve actuators 86 and 88 and position transducers 82 and 84 for generating feedback signals for controlling the valve actuators 86 and 88.

The functions and operations of controller 50 are readily adaptable to microprocessor implementation. Analog-to-digital conversion of input pressure signals to controller 50, and digital-to-analog conversion of the output valve commands may be accomplished as is well known in the art.

Although the present invention has been described with reference to the particular embodiment herein set forth, it is understood that the present disclosure has been made only by way of example and that numerous changes in the details of the equipment or method described may be resorted to without departing from the spirit and scope of the invention. Thus, the scope of the invention should not be limited by the foregoing specification but only by the scope of the claims appended hereto.

What is claimed is:

1. A pressure demand dilution regulator for regulating a fluid mixing apparatus which supplies a breathable fluid in response to changes in the physiological breathing needs of a recipient, said regulator comprising:

an oxygen inlet adapted to be connected to an oxygen source and an air inlet adapted to be connected to an air source;

an oxygen flow control means connected to said oxygen inlet for adjusting oxygen flow from said oxygen source;

an air flow control means connected to said air inlet for adjusting air flow from said air source;

inhalation means connected to said oxygen inlet and said air inlet;

sensor means for generating a signal representative of suction pressure in said inhalation means caused by the recipient's breathing gas supplied through said oxygen and air flow control means;

means for sensing altitude;

means coupled to said altitude sensing means for generating signals corresponding to a prescribed pressure and oxygen concentration percentage based on altitude;

means for comparing said sensed signal representative of suction pressure with said prescribed pressure signal to develop an error signal; and means coupled to said oxygen concentration generating means for proportionally biasing said error signal between said oxygen flow control means and said air flow control means according to said prescribed oxygen concentration percentage.

2. A pressure demand dilution regulator, as described in claim 1, wherein the oxygen flow control means and the air flow control means are electromechanical servoactuated valves.

3. The pressure demand dilution regulator as described in claim 1, wherein said means of sensing the suction pressure in said inhalation means is a pressure transducer.

4. The pressure demand dilution device as described in claim 1, wherein said inhalation means is a pilot's mask.

5. The pressure demand dilution device as described in claim 1, wherein said error signal is compensated by a proportional plus integral controller.

6. The pressure demand dilution device as described in claim 2, wherein said electromechanical servoactuated valves have connected thereto a feedback loop containing a transducer for sensing displacement corresponding to opening of said valves.

7. The pressure demand dilution device as described in claim 1, wherein said means for generating signals corresponding to a prescribed pressure and oxygen concentration percentage comprise algorithms having as an input variable a value corresponding to altitude sensed by said altitude sensing means.

8. The pressure demand dilution device as described in claim 7, wherein said means for generating signals corresponding to a prescribed pressure and oxygen concentration percentage, said means for comparing said sensed signals representative of suction pressure with said prescribed pressure signal to develop an error signal, and said means coupled to said oxygen concentration generating means for proportionally biasing said error signal include a microprocessor.

* * * * *